US006426998B1

(12) United States Patent
Hell et al.

(10) Patent No.: US 6,426,998 B1
(45) Date of Patent: Jul. 30, 2002

(54) X-RAY RADIATOR WITH ROTATING BULB TUBE WITH EXTERIORLY PROFILED ANODE TO IMPROVE COOLING

(75) Inventors: Erich Hell; Detleff Mattern, both of Erlangen; Thomas Ohrndorf, Altendorf; Peter Schardt, Roettenbach, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/350,445

(22) Filed: Jul. 9, 1999

(30) Foreign Application Priority Data

Jul. 9, 1998 (DE) ..... 198 30 815

(51) Int. Cl.[7] ..... H61J 35/10

(52) U.S. Cl. ..... 378/141; 378/127; 378/144; 378/200

(58) Field of Search ..... 378/143, 144, 378/141, 125, 127, 130, 200; 313/39, 40, 41, 44, 45

(56) References Cited

U.S. PATENT DOCUMENTS 2,900,543 A * 4/1959 Heuse ..... 378/130
3,751,702 A * 8/1973 Dietz ..... 378/125
3,819,971 A * 6/1974 Kaplan et al. ..... 378/144
H312 H * 7/1987 Parker ..... 378/127
4,916,015 A * 4/1990 Schaffner et al. ..... 378/141
4,943,989 A * 7/1990 Lounsberry et al. ..... 378/142
4,993,055 A * 2/1991 Rand et al. ..... 378/125
5,056,127 A * 10/1991 Iversen et al. ..... 378/130
5,629,970 A * 5/1997 Woodruff et al. ..... 378/141
5,703,926 A * 12/1997 Bischof ..... 378/200
6,084,942 A * 7/2000 Hell et al. ..... 378/141

FOREIGN PATENT DOCUMENTS

DE PS 718031 2/1942
DE OS 2 350 807 5/1974

* cited by examiner

*Primary Examiner*—Drew Dunn
(74) *Attorney, Agent, or Firm*—Schiff Hardin & Waite

(57) ABSTRACT

An x-ray radiator has a housing containing a fluid coolant wherein a rotating bulb x-ray tube is rotatably seated, the rotating bulb x-ray tube having an evacuated vacuum housing containing a cathode and an anode, with the anode forming a wall of the vacuum housing and having an exterior charged by the coolant. The anode has a profiling at its exterior that enlarges the surface area contact between the exterior of the anode and the coolant. The profiling can be in the form of at least one channel proceeding from as a spiral from a central region of the anode toward its periphery.

3 Claims, 1 Drawing Sheet

X-RAY RADIATOR WITH ROTATING BULB TUBE WITH EXTERIORLY PROFILED ANODE TO IMPROVE COOLING

BACKGROUND OF THE INVENTION

1. Field of the Invention

The present invention is directed to an x-ray radiator of the type having a housing containing a fluid coolant wherein a rotating bulb tube is rotatably mounted, the rotating bulb tube having an evacuated vacuum housing containing a cathode and an anode, the anode forming a wall of the vacuum housing being charged at its exterior by the coolant.

2. Description of the Prior Art

An x-ray radiator of the above type whose anode is directly cooled by the coolant is disclosed, for example, in U.S. Pat. No. 4,993,055. Such x-ray radiators basically allow the realization of extremely high x-ray powers but, in practice, present the problem of achieving the necessary heat transmission coefficients and the heat transmission from the exterior of the anode to the coolant in contact therewith.

The heat transmission from the exterior of the anode to the coolant can be improved by increasing the speed of the rotating bulb tube and/or the average radius of the anode, which approximately corresponds to the focal path radius. Both measures are possible only to a limited extent since enlarging the average radius of the anode is limited by the maximally allowed structural size of the x-ray radiator, and the frictional losses occurring between the rotating bulb tube and the coolant rapidly become unacceptably high with increasing speed of the rotating bulb tube, at least in the case of liquid coolants.

SUMMARY OF THE INVENTION

An object of the present invention is to provide an x-ray radiator of the type initially wherein an improvement of the heat transfer from the outside of the anode to the coolant is achieved without increasing the average radius of the anode and without increasing the rotational speed of the rotating bulb tube.

This object is inventively achieved in an x-ray radiator having a housing containing a fluid coolant, i.e. gaseous or liquid coolant wherein a rotating bulb tube is rotatably mounted, the rotating bulb tube having an evacuated vacuum housing containing a cathode and an anode, the anode forming a wall of the vacuum housing and being charged by the coolant at its exterior and having a profiling that increases the surface area of the exterior. For example, the exterior can be roughened and/or provided with ribs and/or with at least one channel in preferred embodiments of the invention. As a result of such an enlargement of the surface area of the exterior of the anode by profiling, more heat per time unit can be transmitted from the exterior of the anode to the coolant at a given speed of the rotating bulb tube and given average diameter of the anode. Given a constant quantity of heat transmitted per time unit from the exterior of the anode to the coolant, alternatively, the average diameter of the anode and/or the speed of the rotating bulb tube can be reduced.

German Patent 718031 and German OS 23 50 807 disclose x-ray tubes with a stationary anode which is a hollow body and whose interior charged with a coolant, the interior being provided with a profiling that increases the surface thereof. The anode does not rotate relative to the coolant nor is the exterior of the anode charged by the coolant.

This is also true of an x-ray tube disclosed in U.S. Pat. No. 5,056,127 with a rotating anode. Here, too, the anode is as hollow body whose inside charged by a coolant is provided with a profiling that increases the surface thereof. The coolant is located in the rotating anode.

In a preferred embodiment of the invention the profiling is fashioned such that it develops a conveying effect for the coolant. In this case, thus, the profiling performs an additional function of promoting a flow of the coolant, for example in a coolant circulation path, so that a pump for maintaining such a circulation is either completely dispensable, or can exhibit reduced power.

In one version of the invention, an especially good conveying effect is achieved wherein the exterior of the anode is arranged adjacent to and opposite a transverse wall of the housing that has an opening penetrated by a bearing shaft serving for the rotatable bearing of the rotating bulb tube in the housing such that an inflow cross section for coolant remains, the coolant flowing from the housing in the region of the outer circumference of the anode. The spacing between the transverse wall and the outside of the anode that enables an optimum conveying effect is dependent on the selected type of profiling; this can be determined by a person skilled in the art on the basis of simple trials.

A good conveying effect is achieved when the profiling of the exterior of the anode is formed by at least one channel proceeding helically from the center of the anode toward its periphery.

DESCRIPTION OF THE PREFERRED EMBODIMENTS

Figure 3:
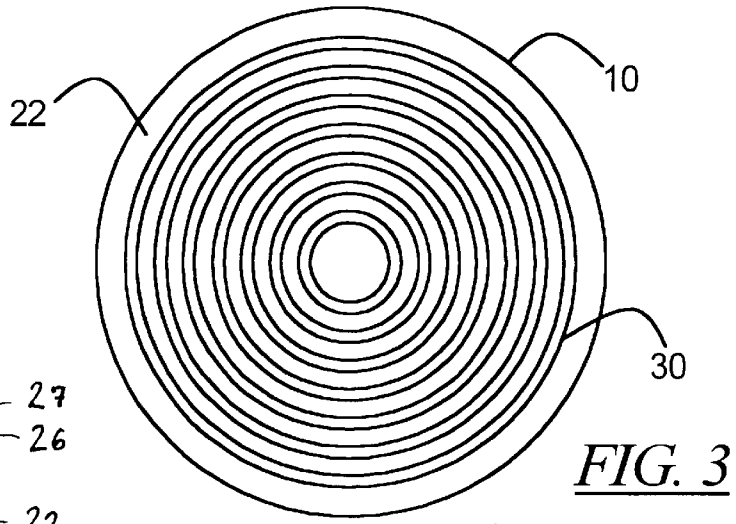
FIG. 3 is a view of the exterior of the anode of the rotating bulb tube contained in the x-ray radiator according to FIG. 1, in a second embodiment.
Figure 2:
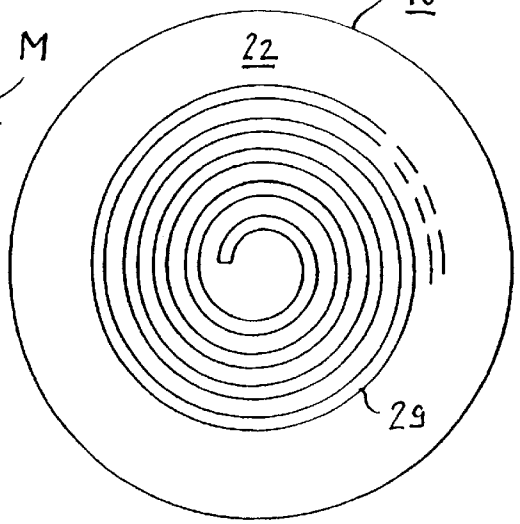
FIG. 2 is a view of the exterior of the anode of the rotating bulb tube contained in the x-ray radiator according to FIG. 1, in a first embodiment.

The inventive x-ray radiator has a housing 1 in which a rotating bulb tube 2 is seated so as to be rotatable around the center axis M of the arrangement.

The rotating bulb tube 2 has a bulb-like, insulating vacuum housing 3 with a substantially cylindrical region 4 and a section 5 connected thereto and expanding in the fashion of a conical frustum.

A cathode 6 as an electron emitter is arranged at the free end of the cylindrical region 4 of the vacuum housing 3, the cathode 6 being connected via a transformer 7 to a filament current source (not shown) and being connected via a pin-shaped wiper contact to the negative pole of a high-voltage generator (not shown). The cathode 6 has a focusing electrode 8 allocated to it that serves the purpose of setting the cross sectional size of the electron beam 9 that is emitted by the cathode 6 during operation. In a way that is not shown, the focusing electrode is applied to a potential corresponding to the desired cross sectional size of the electron beam 9.

An anode 10 that forms the termination of the internally evacuated vacuum housing 3 is provided at that end of the vacuum housing 3 lying opposite the cathode 6. The anode 10 is an anode dish 11 with an annular edge 12 that, for example, is filled with tungsten.

The vacuum housing 3 with the anode 10 is substantially dynamically balanced with reference to the center axis M and has respective shaft stubs 13 and 14 at its opposite ends. Bearing elements, for example rolling bearings 15 and 16, that accept the shaft stubs 13, 14 are provided in the housing 1 for rotatably bearing the rotating bulb tube 2, i.e. the vacuum housing 3 with the cathode 6 together with the focusing electrode 8 and the anode 10. Drive means (not shown in FIG. 1) are provided in order to be able to place the rotating bulb tube 2 in rotation during operation of the x-ray radiator.

The anode 10, which is electrically insulated from the cathode 6, is at ground potential in what is referred to as single-pole operation, or is at positive potential given two-pole operation. As a result of the tube voltage across the anode 10 and the cathode 6, an electrical field is produced that accelerates the electrons emitted by the cathode 6 in the form of the electron beam 9 in the direction toward the anode 10.

In the described exemplary embodiment, the electron beam 9 corresponding to the tube current and emanating from the cathode 6 exhibits a substantially circular cross section as a result of the substantially dynamically balanced fashioning of the cathode 6 and the focusing electrode 8. In order to assure that the electron beam 9 strikes the conical frustum-shaped anode edge 10 in a defined focal spot referenced FS in order to produce x-rays, a magnet system 17 is provided that surrounds the cylindrical region 4 of the vacuum housing 3 and is secured in the housing 1 and, accordingly, does not rotate together with the vacuum housing 3 during operation. A supply unit 18 supplies the magnet system 17 with electrical signals that, first, serve for generating a dipole field and, second, serve for generating a quadrupole field superimposed thereon.

Together with the focusing electrode 8, the quadrupole field serves for focusing the electron beam 9, and thus for realizing a focal spot of defined size. The dipole field serves the purpose of deflecting the electron beam 9 such that the focal spot FS arises at a defined location on the anode edge 12. The electrical signals supplied to the magnet system 17 by the supply unit 18 can be set with two setting elements 19 and 20 in order to be able to set the focusing and the deflection of the electron beam 9.

Figure 1:
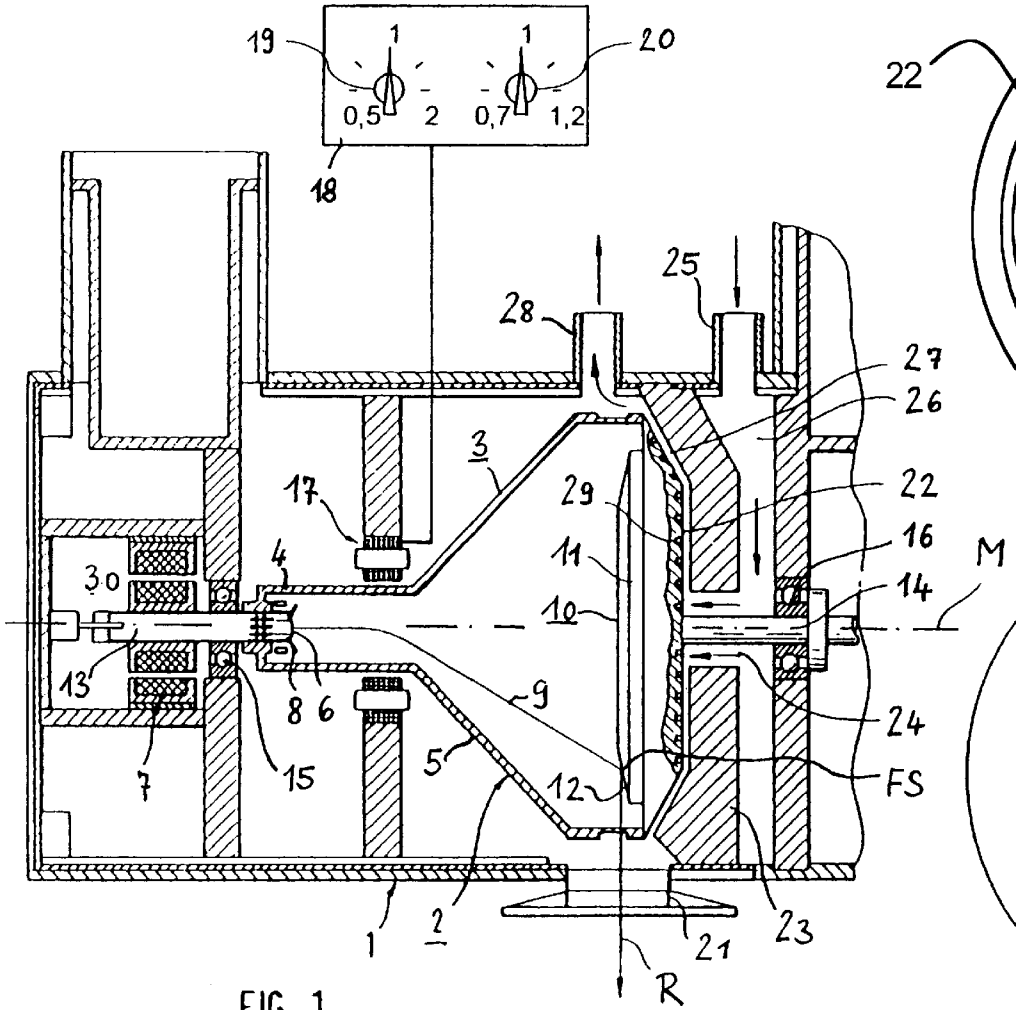
FIG. 1 shows a longitudinal section through an inventive x-ray radiator.

The x-rays emanate from the focal spot FS and is indicated by an arrow R in FIG. 1 emerge from the vacuum housing 2 through a region with reduced wall thickness and emerges from the housing 1 through a beam exit window referenced 21.

The anode 10 has an exterior 22 flooded by a fluid coolant indicated by arrows, this coolant at least filling the housing 1 in that region wherein the vacuum housing 3 is located. The coolant serves for the elimination of the thermal energy arising in the generation of the x-rays, this being on the order of magnitude of 99% of the electrical energy supplied to the rotating bulb tube 2.

The exterior 22 of the anode 10 is opposite, and separated by a gap from, a correspondingly shaped partition wall 23 that has its an inflow opening 24 to its interior for coolant that surrounds the shaft stub 14. The coolant, cooled by an external heat exchanger (not shown), proceeds from the coolant admission 25 of the housing 1 into the back space 26 behind the partition wall 23 and proceeds via the inflow opening 24 into the space 24 between the outside 22 of the anode 10 and the partition wall 23. The coolant flows radially outwardly in this interspace toward the coolant discharge 28. In order to increase the heat transfer coefficient and thus the heat transmission from the anode 10 to the coolant, and thus to increase the loadability of the anode 10, the exterior 22 of the anode 10 is provided with a profiling that enlarges its surface. In the illustrated exemplary embodiment, the profiling is fashioned as a channel 29 proceeding in a spiral from a center region of the anode 10 to its periphery. Alternatively, a mere roughening of the surface would be adequate for many purposes. In addition to the increase in the contact surface to the coolant which is thereby caused, a form of pumping action arises for the coolant conveyed outwardly in the helical channel by the centrifugal forces, so that the flow in the coolant circulation path is improved. As warranted, a separate circulation pump in the coolant circulation path can be completely eliminated by this measure. Instead of the spiral channel 29, however, a number of concentric channels 30 can be used as shown in FIG. 3.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

a housing having an interior transverse wall with an opening therein, said housing containing a fluid coolant;

a rotating bulb x-ray tube rotatably mounted in said housing, said rotating bulb x-ray tube having an evacuated housing containing a cathode and an anode, said anode forming a wall of said evacuated housing, said anode being disposed opposite said transverse wall with a gap between an exterior of said anode and said transverse wall and being in contact with said fluid coolant at said exterior of said anode, and a bearing shaft for rotatably bearing said rotating bulb x-ray tube, proceeding through said opening in said transverse wall, said opening having a diameter allowing for an inflow of said fluid coolant into said gap;

said anode having a profiling at said exterior which enlarges a surface area of contact between said anode and said fluid coolant; and said exterior of said anode having an exterior shape, and said transverse wall having a shape conforming to said exterior shape, the conforming shapes of the exterior of the anode and the transverse wall, in combination with said profiling, producing pumping action for facilitating flow of said fluid coolant through said gap.

2. An x-ray radiator as claimed in claim 1 wherein said profiling comprises at least one channel proceeding in a spiral from a central portion of said exterior of said anode toward a peripheral portion of said exterior of said anode.

3. An x-ray radiator as claimed in claim 1 wherein said profiling comprises a plurality of concentric annular channels on said exterior of said anode.

* * * * *